US009723919B1

(12) United States Patent
Randolph et al.

(10) Patent No.: US 9,723,919 B1
(45) Date of Patent: Aug. 8, 2017

(54) COMBINATION FOLDABLE AND ADJUSTABLE WORKSTATION

(71) Applicant: Symbiote, Inc., Zeeland, MI (US)

(72) Inventors: Travis M. Randolph, Saugatuck, MI (US); Heather L. Boeve, Holland, MI (US)

(73) Assignee: Symbiote, Inc., Zeeland, MI (US)

( * ) Notice: Subject to any disclaimer, the term of this patent is extended or adjusted under 35 U.S.C. 154(b) by 0 days.

(21) Appl. No.: 15/018,969

(22) Filed: Feb. 9, 2016

(51) Int. Cl.

| | |
|---|---|
| ***A47B 85/00*** | (2006.01) |
| ***A47B 21/02*** | (2006.01) |
| ***A47B 3/00*** | (2006.01) |
| ***A47B 13/02*** | (2006.01) |
| ***A47B 83/00*** | (2006.01) |
| ***A47B 21/06*** | (2006.01) |
| ***A47B 21/04*** | (2006.01) |
| ***A47B 9/12*** | (2006.01) |
| ***F21V 33/00*** | (2006.01) |

(52) U.S. Cl.
CPC ..... *A47B 21/02* (2013.01); *A47B 3/00* (2013.01); *A47B 9/12* (2013.01); *A47B 13/02* (2013.01); *A47B 21/04* (2013.01); *A47B 21/06* (2013.01); *A47B 83/001* (2013.01); *F21V 33/0012* (2013.01); *A47B 2021/066* (2013.01); *A47B 2083/006* (2013.01)

(58) Field of Classification Search
CPC ..... A47B 21/00; A47B 2200/008; A47B 9/06; A47B 9/08; A47B 9/12; A47B 9/20; A47B 57/30
USPC ..... 108/50.01, 50.02, 115, 10, 147, 144.11, 108/147.12, 147.19
See application file for complete search history.

(56) References Cited

U.S. PATENT DOCUMENTS

| | | | | | |
|---|---|---|---|---|---|
| 2,305,244 | A * | 12/1942 | Erickson | A47F 5/0018 | 108/10 |
| 3,436,092 | A * | 4/1969 | Werner | A47B 31/04 | 108/115 |
| 4,099,469 | A * | 7/1978 | Sahli | A47B 3/00 | 108/1 |
| 4,651,652 | A * | 3/1987 | Wyckoff | A47B 9/12 | 108/147 |
| 4,790,611 | A * | 12/1988 | Craner | A47B 57/00 | 108/147 |
| 4,861,121 | A * | 8/1989 | Gotz | A47B 21/00 | 312/22 |
| 5,313,892 | A * | 5/1994 | Tice | D05B 75/00 | 108/147 |
| 5,322,025 | A * | 6/1994 | Sherman | A47B 9/10 | 108/147 |
| 5,337,657 | A * | 8/1994 | Diffrient | A47B 3/00 | 108/115 |
| 5,544,593 | A * | 8/1996 | Canfield | A47B 9/14 | 108/110 |

(Continued)

*Primary Examiner* — Jose V Chen
(74) *Attorney, Agent, or Firm* — Warner Norcross & Judd LLP

(57) ABSTRACT

A workstation includes a frame supporting a work surface upon which a task can be completed and/or an item can be stored. The workstation can include a drive system for adjusting a height of the work surface above a surface supporting the workstation. The workstation can also be configured such that the work surface and other components of the workstation can be moved between an in use mode and a lower profile storage and/or transportation mode.

20 Claims, 17 Drawing Sheets

(56) References Cited

U.S. PATENT DOCUMENTS 6,048,044 A 4/2000 Biggel et al.
6,053,588 A 4/2000 Biggel et al.
6,286,441 B1 9/2001 Burdi et al.
6,550,724 B2 * 4/2003 Gosling ..... A47B 83/001 108/144.11
6,682,030 B2 1/2004 Santoro et al.
6,994,034 B2 * 2/2006 Chang ..... A47B 21/00 108/115
7,077,068 B1 * 7/2006 Agee ..... A47B 9/00 108/147
7,412,931 B2 8/2008 Seidl et al.
7,743,716 B1 * 6/2010 Burka ..... A47B 9/12 108/147
8,196,526 B2 * 6/2012 Rheault ..... A47B 13/10 108/50.01
8,534,779 B2 * 9/2013 Schaaf ..... A47B 46/005 312/272.5
8,539,888 B2 * 9/2013 Hernandez ..... A47B 85/06 108/115
8,661,989 B2 3/2014 Tsai et al.
8,662,605 B2 * 3/2014 McRorie ..... B62B 3/02 108/38
2003/0024444 A1 * 2/2003 Welch ..... A47F 5/137 108/115
2005/0045077 A1 3/2005 Bober
2005/0109251 A1 * 5/2005 Bentschneider ..... B23P 21/00 108/147
2006/0230992 A1 * 10/2006 Newhouse ..... A47B 9/18 108/147
2008/0168930 A1 * 7/2008 Calero ..... A47B 21/0314 108/50.02
2008/0295742 A1 * 12/2008 Henriott ..... A47B 21/00 108/6
2012/0031310 A1 * 2/2012 Jedrysik ..... A47B 21/0314 108/50.01
2014/0238279 A1 * 8/2014 Maas ..... A47B 21/02 108/146

* cited by examiner

COMBINATION FOLDABLE AND ADJUSTABLE WORKSTATION

BACKGROUND OF THE INVENTION

Conventional workstations exist which have a work surface that is height adjustable, either manually or using an electric motor, to accommodate particular tasks, to accommodate switching between standing and sitting postures, and/or to accommodate users of different heights. For example, U.S. Pat. No. 6,286,441 to Burdi et al. discloses a motorized height adjustable table that includes two drive assemblies and a controller for canceling out the difference in height displacement between the two drive assemblies. U.S. Pat. No. 7,412,931 discloses a desk assembly that includes a counterbalanced height adjustment mechanism that is operated by a hand crank for adjusting the height of the work surface. These types of workstations are not easily relocated to accommodate transport, installation, changing work space needs, or for placement into storage. After the initial assembly, these types of workstations require a large foot print both in use and in storage and require significant time and effort to disassemble. In addition, these types of workstations do not take into consideration the need to supply electrical power and/or communications via cables to items stored on or within the workstation.

Conventional workstations exist that are collapsible in order to provide workstations that are transportable to accommodate changing work place needs. For example, U.S. Pat. No. 6,048,044 to Biggel et al. and U.S. Pat. No. 6,053,588 to Biggel et al. discloses a collapsible workstation that includes hingedly attached walls and foldable work surfaces. While these types of workstations are configured for transportation, they are one size fits all and are not adjustable once assembled to accommodate particular tasks or to accommodate users of different heights. In addition, even when in the collapsed condition for transport, these workstations still require a large amount of space during storage and transportation.

SUMMARY OF THE INVENTION

The present invention provides a collapsible work station including a work surface upon which a task can be completed and/or an item can be stored. The work station includes a frame with a pair of vertical rails connected by at least one horizontal support rail, a base joined with each of the pair of vertical rails at a first end thereof to support the frame on a surface; and a work surface extending between the pair of vertical rails. The work surface is moveable between a first position in which the work surface extends perpendicular to the frame and a second position in which the work surface is parallel with the frame. The work surface is also configured to move upward and downward along a length of the pair of vertical rails to adjust a height of the work surface; and the movement of the work surface from the first position to the second decreases a profile of the work station to facilitate storage and transportation of the work station.

In one embodiment, the work station includes at least one door panel mounted to one of the pair of vertical rails, the door panel moveable between a closed position in which the at least one door panel extends at least partially between the pair of vertical rails and an open position in which the at least one door panel extends away from the pair of vertical rails. In another embodiment, the base includes at least one support leg that is moveable between a first position in which the support leg extends perpendicular to the frame and a second position in which the support leg is parallel with the frame.

In another embodiment, the work station also includes at least one accessory extending between the pair of vertical rails and configured to move upward and downward along the length of the pair of vertical rails to adjust a height of the at least one work station accessory. The accessory may include, among other things, an acoustical panel, a privacy panel, a display screen, a power strip, an accessory mounting panel, and combinations thereof.

In yet another embodiment, the work station may include a drive system for adjusting a vertical height of the work surface. In this embodiment, the frame may include a pair of vertical side rails, with each vertical side rail including a drive system cavity configured to house the drive system; a cable cavity coupled with the drive system cavity such that at least one cable stored within the cable cavity can pass into the drive system cavity; a frame connector cavity; and an exit slot coupled with the drive system cavity and configured to allow the support member and the at least one cable to extend from the drive system cavity to an exterior of the vertical side rail. A horizontal support rail may be coupled at a first end with one of the pair of vertical side rails and at a second end with the other of the pair of vertical side rails through the frame connector cavity.

Figure 1:
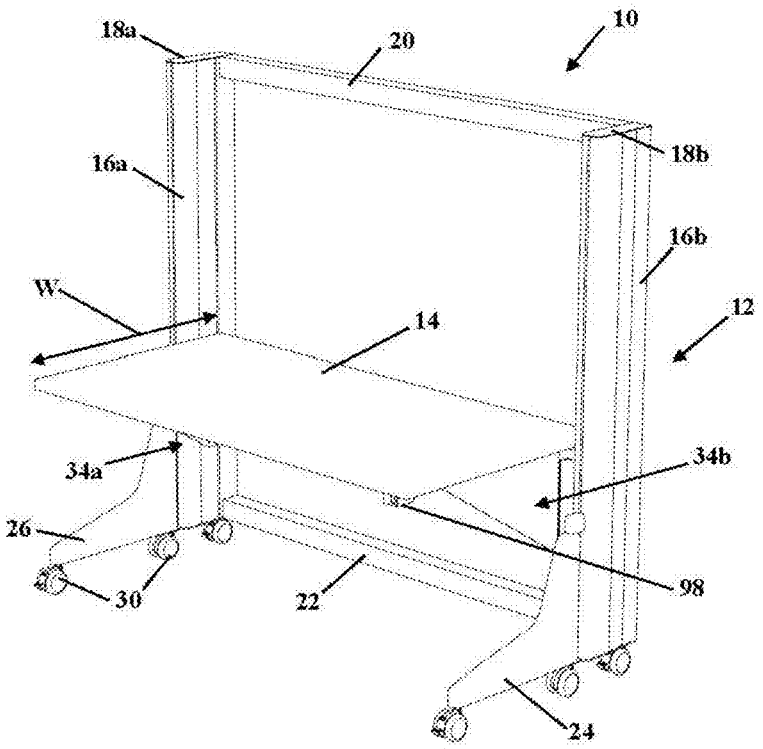
FIG. 1 is a perspective view of a workstation according to an embodiment of the invention.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

I. Structure

Figure 2:
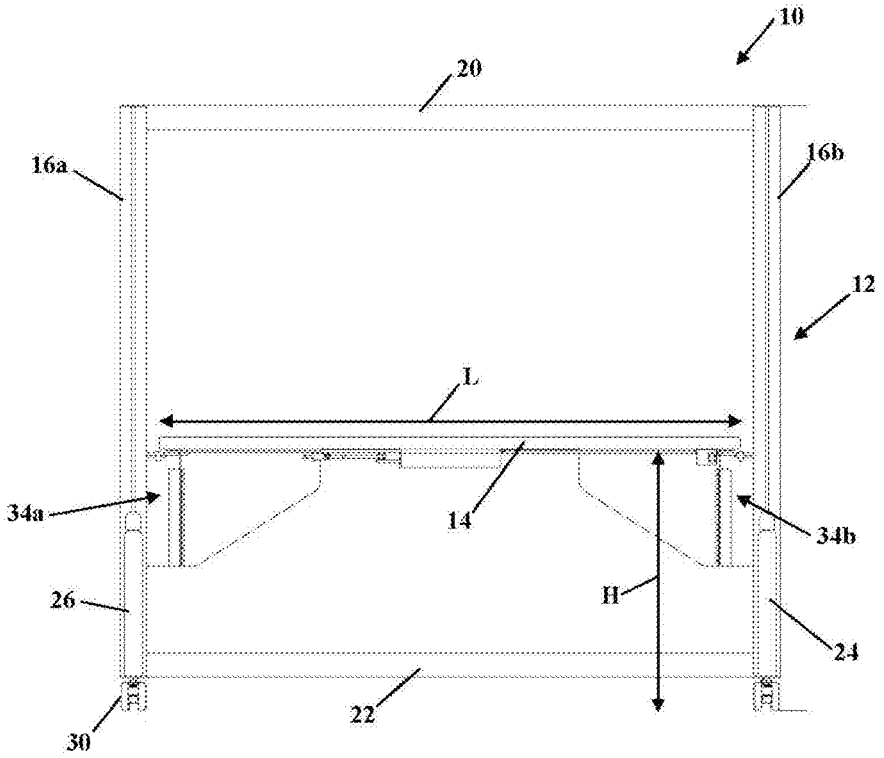
FIG. 2 is a front view of the workstation of FIG. 1.

The embodiments of the invention described herein relate to a workstation having a work surface that is height adjustable and that is moveable between an extended, in use position and a folded, storage/transportation position. FIGS. 1-2 illustrate a workstation in accordance with an embodiment of the invention and is generally designated 10. The workstation 10 includes a frame 12 and a work surface 14 supported by the frame 12. The frame 12 includes a pair of vertical rails 16*a*, 16*b* between which the work surface 14 extends. Each vertical rail 16*a*, 16*b* can include a cover 18*a*, 18*b* closing the upper end of the rails 16*a*, 16*b*. The frame 12 can also optionally include one or more horizontal rails, such as an upper horizontal rail 20 and a lower horizontal rail 22, coupled with the vertical rails 16*a*, 16*b* at each end thereof. The frame 12 can be made from any suitable natural or synthetic material or combination of materials, non-limiting examples of which include metal, steel, metal alloys, wood, and polymeric materials.

The workstation 10 can also include a base for supporting the frame 12 on a surface and providing stability to the workstation 10 that can be in the form of a pair of support legs 24, 26 at least partially forming the base. Each support leg 24, 26 can be coupled with the adjacent vertical rail 16*a*, 16*b*, respectively, for providing support and stability to the workstation 10, particularly when the work surface 14 is in use. As used herein, the work surface 14 is considered to be in use when the work surface 14 is supporting an object and/or when a user is performing a task that utilizes at least a portion of the work surface 14. Each support leg 24, 26 can optionally be rotatably coupled with the vertical rails 16*a*, 16*b*, as illustrated, or fixedly coupled with the vertical rails 16*a*, 16*b*. Each support leg 24, 26 can be rotatably coupled with the adjacent vertical rail 16*a*, 16*b* using any suitable connection, such as a hinged connection or pivot bearing connection, for example. Alternatively, the support legs 24, 26 can be integrally formed with at least a portion of the vertical rails 16*a*, 16*b*. Casters 30 can optionally be coupled with the support legs 24, 26 and/or a bottom end of the vertical rails 16*a*, 16*b* to facilitate movement of the workstation 10 across a surface.

The work surface 14 has a width W and a length L and can be supported by the frame 12 through a pair of support members 34*a*, 34*b* at a height H above a surface upon which the work station 10 is supported. The work surface 14 can be made from any suitable natural or synthetic material or combination of materials, non-limiting examples of which include metal, steel, metal alloys, wood, quartz, granite, resin based materials, and polymeric materials. As can best be seen in FIG. 2, support member 34*a* is joined with the work surface 14 adjacent a first end of the work surface 14 and a similar support member 34*b* is joined with the work surface 14 adjacent a second end of the work surface 14, opposite the first. Each of the support members 34*a*, 34*b* is received by the corresponding adjacent vertical rail 16*a*, 16*b* for coupling with a suitable drive system, which will be described in more detail below.

Figure 3:
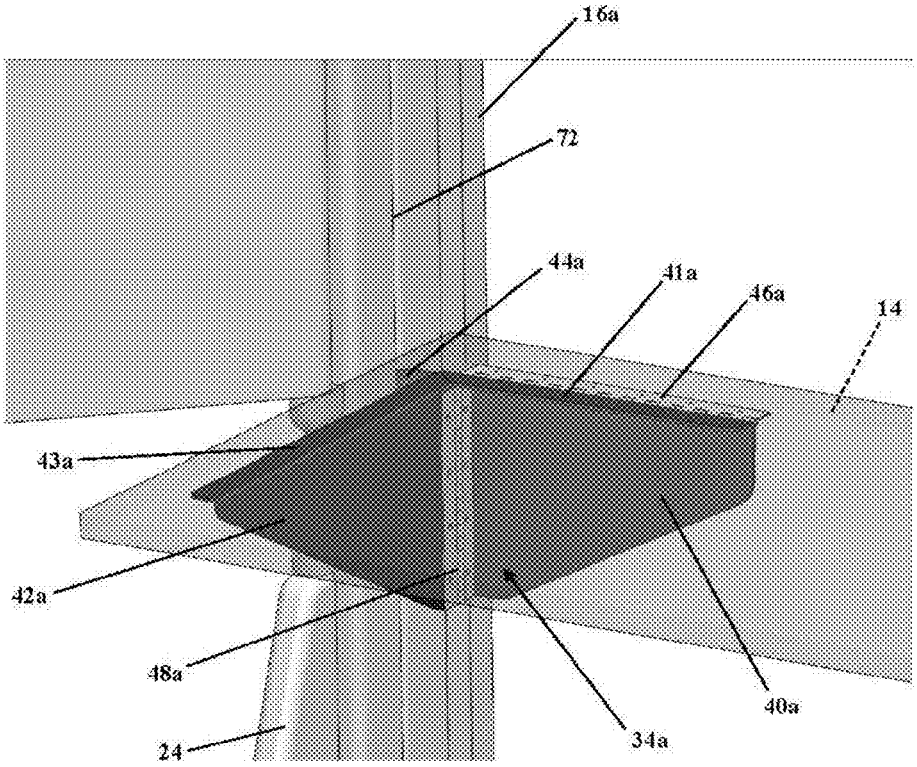
FIG. 3 is a first partial view of the workstation of FIG. 1.

Referring now to FIG. 3, the support member 34*a* is described in more detail. While only one of the support members 34*a* is illustrated, it will be understand that the other support member 34*b* is configured in a similar manner, with similar elements labeled with the suffix "b". The support member 34*a* can include a first support arm 40*a*, an optional second support arm 42*a*, and a mounting arm 44*a*. The first support arm 40*a* can extend along at least a portion of a length L of the work surface 14 and optionally include a support flange 41*a* that abuts an underside of the work surface 14 to facilitate supporting the work surface 14. In one example, the first support arm 40*a* can extend across the full length L of the work surface 14 such that the support member 34*b* does not need to include a separate support flange 41*b*. In this manner, a single panel can extend across the length L of the work surface 14 for supporting the work surface 14 and also optionally function as a modesty panel. The first support arm 40*a* can be pivotably coupled with the work surface 14 using any suitable fastener, such as a hinge 46*a*, such that the work surface 14 can be pivoted about the hinge 46*a* from an extended position (FIG. 3) in which the work surface 14 extends perpendicular to the vertical rails 16*a*, 16*b* and a folded position in which the work surface 14 extends generally parallel with the vertical rails 16*a*, 16*b* (FIG. 11).

Figure 11:
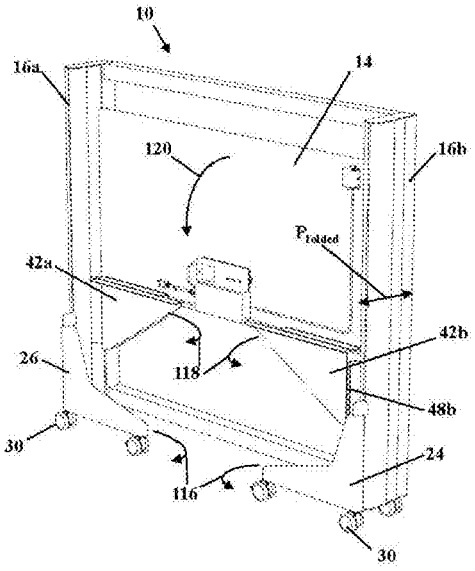

The optional second support arm 42*a* can be pivotably coupled with the first support arm 40*a* by a hinge 48*a* such that the second support arm 42*a* can be pivoted into an extended position in which the second support arm 42*a* is perpendicular with the first support arm 40*a* for supporting the work surface 14 (FIG. 3) and a folded position in which the second support arm 42*a* is generally parallel with the first support arm 40*a* (FIG. 11). The second support arm 42*a* can also include a support flange 43*a* that abuts an underside of the work surface 14 to facilitate supporting the works surface 14.

While the second support arm 42*a* is illustrated as being hingedly connected with the first support arm 40*a*, alternative mechanisms for selectively extending the second support arm 42*a* along the width W of the work surface 14 are also within the scope of the invention. For example, the second support arm 42*a* could alternatively be in the form of a telescoping arm that can be slid into an extended position to support the work surface 14 when the work surface 14 is in the extended position and slid back into a retracted position when not in use. Alternatively, the second support arm 42*a* can extend diagonally across at least a portion of the work surface 14 to support the work surface 14. The presence and/or dimensions of the second support arm 42*a* can depend on several factors, including the intended use of the work surface 14 and the dimensions of the work surface 14. For example, if the work station 10 is configured for use in supporting heavy items on the work surface 14, the additional second support arm 42*a* can be used to decrease stress on the hinge 46*a* to minimize the likelihood that the work surface 14 will crack or separate from the hinge 46*a*. Alternatively, the support member 34*a* can be configured to support the work surface 14 without the use of a second support arm 42*a* based on a strength of the other parts of the support member 34*a* and/or the intended use of the work surface 14.

Figure 4:
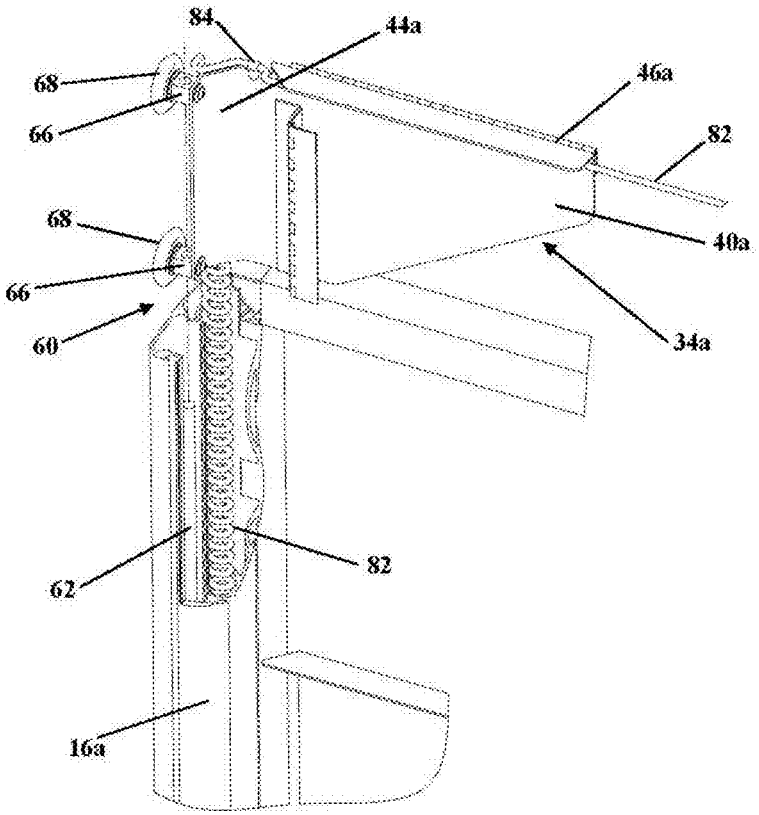
FIG. 4 is a second partial view of the workstation of FIG. 1.
Figure 5:
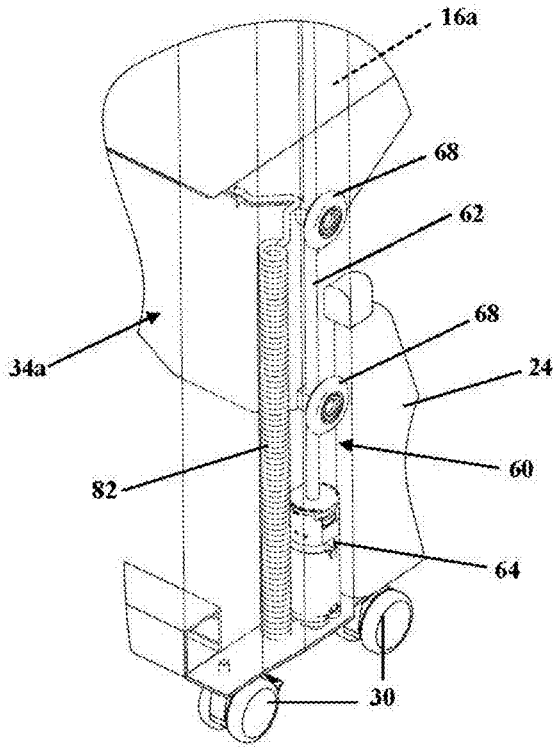
FIG. 5 is a third partial view of the workstation of FIG. 1.

Referring now to FIGS. 4 and 5, the mounting arm 44*a* can be integrally formed with the first support arm 40*a*, as illustrated, or can be a separate element that is coupled with the first support arm 40*a*. The mounting arm 44*a* can be operably coupled with a drive system 60 for selectively raising and lowering the relative position of the work surface 14 with respect to the vertical rails 16*a*, 16*b* to adjust the height of the work surface 14 above the surface supporting the work station 10. In the embodiment illustrated in FIGS. 4-6, the drive system 60 can include a drive shaft 62 that is rotated by a motor 64. The mounting arm 44*a* can be coupled with one or more bearing mounts 66 that include an aperture for receiving the drive shaft 62 and a bearing wheel 68.

Figure 6A:
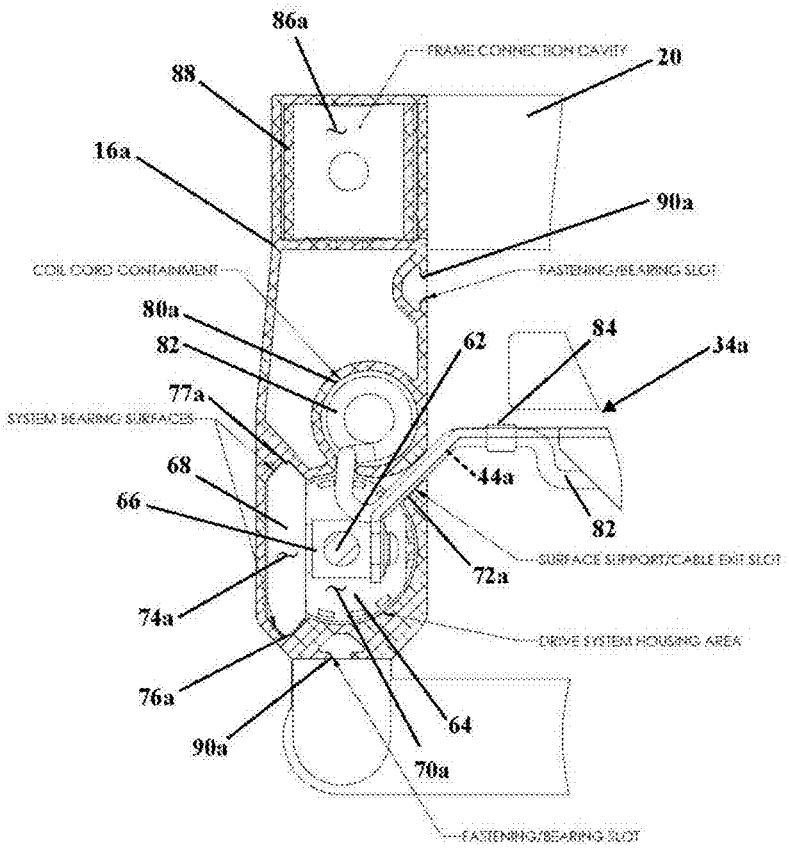
FIG. 6*a* is a cross-sectional view of a vertical rail of a workstation according to an embodiment of the invention.

Referring now to FIG. 6*a*, the drive system 60 can be located within an interior of the vertical rail 16*a*. The vertical rail 16*a* can include a drive system cavity 70*a* configured to receive the drive system 60 therein and a vertical slot 72*a* extending along at least a portion of a length of the vertical rail 16*a* through which a portion of the mounting arm 44*a* passes. The vertical rail 16*a* can also include a bearing cavity 74*a*, adjacent the drive system cavity 70*a*, which includes forward and rearward bearing surfaces 76*a* and 77*a* against which the bearing wheels 68 ride as the bearing mounts 66 travel along the length of the drive shaft 62 during operation of the drive system 60.

The vertical rail 16*a* can also include a cable cavity 80*a* for housing an extendable and retractable cable 82 that extends through the vertical slot 72*a* for connection with a component that is movable with the work surface 14, such as a motor control device 98 (FIG. 1) that selectively operates the drive system 60. The extendable/retractable cable 82 extends through the vertical slot 72*a* and can optionally be coupled with the mounting arm 44*a*, such as through one or more fasteners 84, such that the extendable/retractable cable 82 can extend and retract as the drive system 60 is operated to adjust the vertical height of the work surface 14. While the extendable/retractable cable 82 is illustrated as a coiled cable, other types of cables capable of extension and retraction can also be utilized.

The vertical rail 16*a* can also optionally include a connection cavity 86*a* for receipt of a depending mounting leg 88 of the upper horizontal rail 20. The vertical rail 16*a* can include additional elements, such as one or more additional power or communication cables or an additional support member for supporting a work station accessory. The interior of the vertical rail 16*a* can be divided into one or more cavities which are at least in partial communication, such as the drive system cavity 70*a*, the bearing cavity 74*a*, and the cable cavity 80*a*, and/or one or more cavities that are not in communication with the other cavities, such as the connection cavity 86*a*. The vertical rail 16*a* can also include one or more fastening apertures 90*a* for mounting additional accessories to the vertical rail 16*a*. Non-limiting examples of workstation accessories include door panels, back panels (e.g. security and/or privacy panels), acoustical panels, accessory mounting panels, power strips, shelving, display screens, and lighting. The fastening apertures 90*a* can be configured to mate with a corresponding feature on the accessory to mount the accessory through an interference fit or a snap fit, for example. Alternatively, the fastening aperture 90*a* can be configured to receive a fastener, such as a screw or pin, for securing the accessory to the vertical rail 16*a*.

Figure 6B:
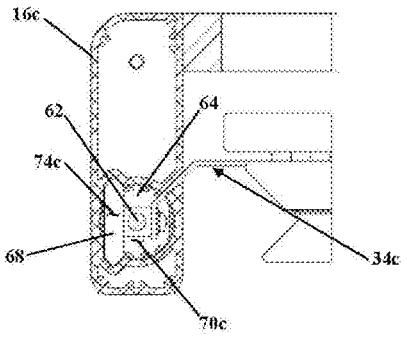
FIG. 6*b* is a cross-sectional view of a vertical rail of a workstation according to another embodiment of the invention.

FIG. 6*b* illustrates an alternative configuration of the vertical rail which is similar to the vertical rails 16*a*, 16*b* except that the vertical rail 16*c* does not include the cable cavity 80*a*, 80*b* or the connection cavity 86*a*, 86*b*. In this manner, the interior of the vertical rails can be customized depending on the configuration of the workstation 10.

While the drive system 60 is discussed in the context of the mounting arm 44*a* of the support member 34*a* for moving the support member 34*a* relative to the vertical rail 16*a*, it will be understood that a similar drive system 60 can be provided in the vertical rail 16*b* for moving the support member 34*b* relative to the vertical rail 16*b* in a manner similar to that described above in FIGS. 4-6 for the support member 34*a*. In addition, while the drive system 60 is described in the context of a screw drive type system, alternative electrically powered or manually powered systems for adjusting the height of the work surface 14 are also within the scope of the invention. For example, the work system 10 could include a manual or electrically powered pulley system for raising or lowering the work surface 14. It is also within the scope of the invention for all or at least part of the drive system 60 and/or the contained portion of the extendable/retractable cable 82 to be located outside the vertical rails 16*a*, 16*b*.

Figure 7:
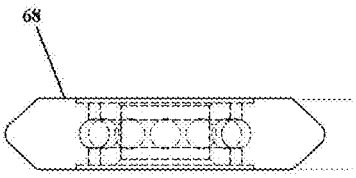
FIG. 7 is a top-down view of a wheel bearing according to an embodiment of the invention.

As illustrated in FIG. 7, the bearing wheel 68 can have a tapered profile that generally corresponds to the shape of the bearing cavity 74*a* and the bearing surfaces 76*a*, 77*a* illustrated in FIG. 6*a*. The tapered profile of the bearing wheel 68 can facilitate interaction of the bearing wheel 68 with the bearing surfaces 76*a* when the work surface 14 is stationary and in the extended position and/or when bearing wheels 68 are in motion during the height adjustment of the work surface 14. When the work surface 14 is in the extended position, the center of mass of the work surface 14 is shifted such that the upper bearing wheel 68 bears more against the forward bearing surface 76*a* and the lower bearing wheel 68 bears more against the rearward bearing surface 77*a*. Non-limiting examples of alternative wheel profiles for the bearing wheels 68 includes round, elliptical, and square (flat). The shape of the bearing cavity 74*a* and bearing surfaces 76*a*, 77*a* can be configured to accommodate the dimensions and profile of the bearing wheels 68.

Figure 8A:
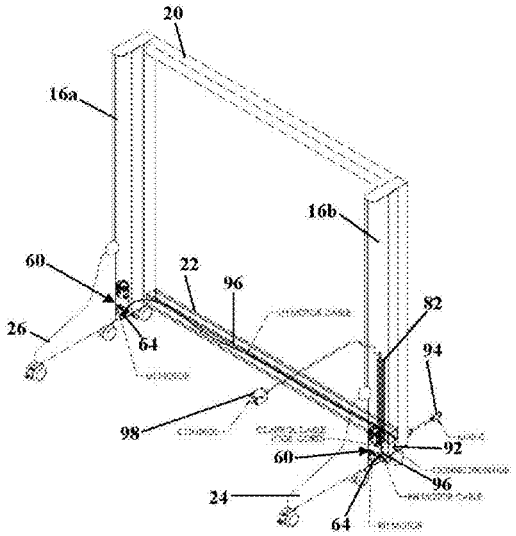
FIG. 8*a* is a schematic illustration of a power and communications scheme for a workstation according to an embodiment of the invention.
Figure 8B:
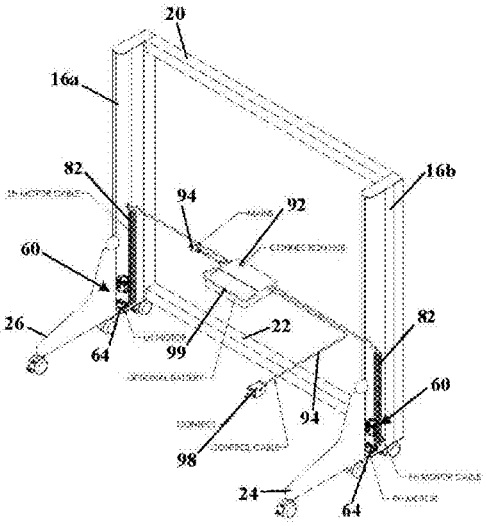
FIG. 8*b* is a schematic illustration of a power and communications scheme for a workstation according to an embodiment of the invention.

FIGS. 8*a* and 8*b* illustrate two alternative configurations for providing electrical power and motor control to the work station 10 in which the work surface 14 is not shown to facilitate viewing of the various components. As illustrated in FIG. 8*a*, in one configuration, the workstation 10 can include a connection hub 92 for receipt and distribution of power and/or data communications. The connection hub 92 can be coupled with a plug 94 suitable for connection with the mains electric power available at the installation site and/or for connection with a suitable data communications port, such as a CAT5 or USB port. The connection hub 92 can be operably coupled with the drive system motor 64 in both vertical rails 16*a*, 16*b* through a corresponding motor cable 96 for providing electrical power and control signals to the motor 64 to operate the drive system 60. The connection hub 92 can also be operably coupled with the motor control 98 through the extendable/retractable cable 82. The motor control 98 can be coupled with the underside of the work surface 14, as shown, or some other component of the workstation 10, such as the vertical rails 16*a*, 16*b*. The connection hub 92 can provide electrical power to the motor control 98 and receive control signals from the motor control 98 for communication with the drive system motors 64 in both vertical rails 16*a*, 16*b*. The connection hub 92 can also include additional cables for transmitting data communications to components of the workstation 10 in a similar manner. In another example, bundled cables can be used to transmit power and data communications from the connection hub 92 to components of the workstation 10.

As illustrated in FIG. 8*a*, the connection hub 92 can be located adjacent the vertical rail 16*b* and connected with the motor 64 in the vertical rail 16*a* through the motor cable 96, which can be run through an interior of the lower horizontal rail 22. The motor cable 96 can convey both electrical power and control signals from the connection hub 92 such that a separate motor extendable/retractable cable 82 within the vertical rail 16*b* is not necessary. Control signals from the motor control 98 can be transmitted through the extendable/retractable cable 82 to the connection hub 92 for transmission to both the motors 64 for controlling the height of the work surface 14. The motor control 98 is connected with the connection hub 92 through the coiled extendable/retractable cable 82 that passes through the vertical slot 72 in the vertical rail 16*b* so that the motor control 98 can move with the work surface 14 as the height of the work surface 14 is adjusted without disrupting the connection between the connection hub 92 and the motor control 98.

In the configuration of FIG. 8*a*, the vertical rail 16*b* can include the cable cavity 80*b* (not shown) for receipt of the extendable/retractable cable 82 which connects the motor control 98 to the connection hub 92. Because the vertical rail 16*a* does not include a component that is coupled with the moveable work surface 14 by a cable, it is not necessary for the vertical rail 16*a* to include a cable cavity 80*a*. The vertical rail 16*a* in the configuration of FIG. 8*a* could be similar to the configuration illustrated in FIG. 6*b* in which the vertical rail 16*c* does not include a cable cavity. In this embodiment, the vertical rail 16*c* could be modified to match the vertical rail 16*b* in exterior appearance and overall configuration for coupling with the additional components of the frame 12. The simplified interior of the vertical rail 16*c* could provide time and cost savings compared to the more complex interior of the vertical rails 16*a*, 16*b*. It is also within the scope of the invention for the configuration of FIG. 8*a* to utilize vertical rails 16*a*, 16*b* having the same interior cross-section configuration.

FIG. 8*b* illustrates an alternative configuration in which both the connection hub 92 and the motor control 98 are coupled with the work surface 14 such that the connection hub 92 and motor control 98 move with the work surface 14. In this configuration, the motor control 98 can be coupled with the connection hub 92 through a fixed length cable connection, as both components are moving together. Because the connection hub 92 is coupled with the work surface 14, the connection hub 92 is coupled with each of the drive system motors 64 in both vertical rails 16*a*, 16*b* through the coiled extendable/retractable cable 82 which extends through the vertical slot 72*a, b* in the vertical rail 16*a*, 16*b* and is extendable and retractable therein as the drive system 60 is operated to raise and/or lower the work surface 14.

In addition to the mains plug 94, or as an alternative to the mains plug 94, the workstation 10 can include an optional battery 99 for providing electrical power to the motor control 98 and the drive system motors 64 as an alternative to using power received through the mains.

It will be understood that the embodiments of the invention are not limited to the electrical power and communications configurations illustrated in FIGS. 8*a* and 8*b* and that various alternatives and combinations can also be utilized without deviating from the scope of the invention. In general any component that is moveable with the work surface 14 that is coupled with a component within the vertical rails 16*a*, 16*b* that does not move with the work surface 14 should be coupled through an extendable and retractable cable, such as the extendable/retractable cable 82. Components that do not move relative to one another do not necessarily need to be coupled by an extendable/retractable cable. For example, as an alternative to the configuration in FIG. 8*a*, the motor control 98 can be mounted to one of the vertical rails 16*a*, 16*b* rather than the work surface 14. In this configuration, the motor control 98 would not move relative to the vertical rails 16*a*, 16*b* and thus a fixed length cable could be used to connect the motor control 98 and the connection hub 92.

In yet another example, the motor control 98 can be wirelessly coupled with the drive system 60 for controlling the motors 64 to selectively adjust the vertical height of the work surface 14 in addition to or as an alternative to the retractable cable 82.

II. Operation

Figure 9:
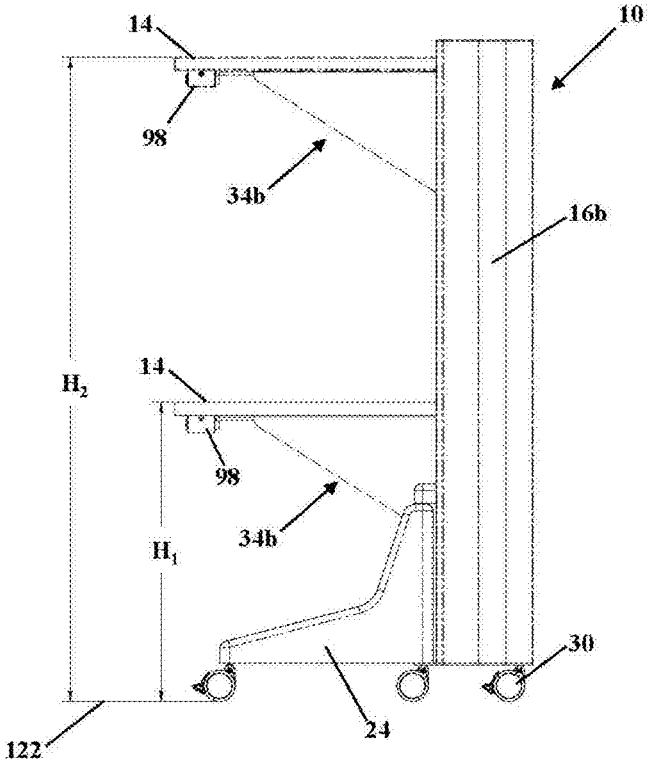
FIG. 9 is a schematic illustration of a height adjustment of a work surface according to an embodiment of the invention.
Figure 10:
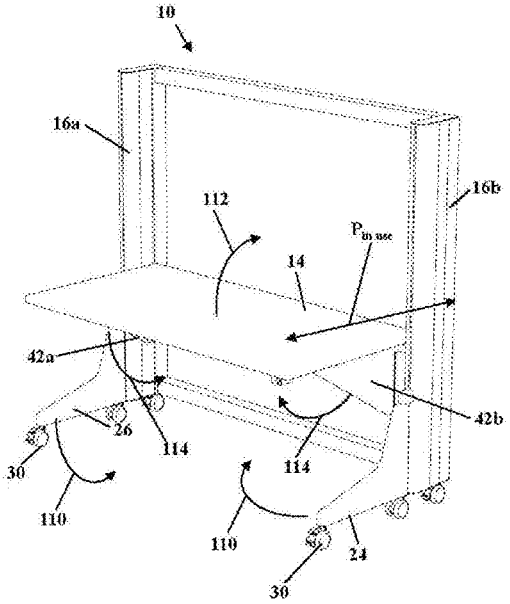
FIGS. 10-11 is a schematic illustration of an operation to change a workstation between an in use mode and a storage and/or transportation mode according to an embodiment of the invention.

FIGS. 9-11 illustrate the workstation 10 in operation for adjusting the height of the work surface 14 and for moving the workstation 10 between an in use mode and a storage and/or transportation mode.

Referring now to FIG. 9, the work surface 14 is height adjustable to accommodate the needs of users and/or to accommodate different types of tasks and work space needs. As illustrated in FIG. 9, the workstation 10 can be configured such that the work surface 14 can be adjusted between a first vertical height $H_1$ above a surface 122 upon which the workstation 10 is supported and a second vertical height $H_2$ using the motor control 98. With reference again to FIGS. 4-6, the motor control 98 can be actuated to control the drive system motor 64 to rotate the drive shaft 62 to adjust the vertical height of the work surface 14. As the drive shaft 62 is rotated, the bearing mounts 66 travel up and/or down a length of the drive shaft 62. Because the bearing mounts 66 are coupled with the mounting arm 44*a*, 44*b* of the support member 34*a*, 34*b* movement of the bearing mounts 66 along the length of the drive shaft 62 results in a corresponding movement of the work surface 14. As the bearing mounts 66 travel along the length of the drive shaft 62, the mounting arm 44*a*, 44*b* travels within the vertical slot 72*a*, 72*b* within the vertical rail 16*a*, 16*b*. The vertical slot 72*a*, 72*b* can extend the entire length of the vertical rail 16*a*, 16*b* or only a portion of the length of the vertical rail 16*a*, 16*b* based on the extent to which the work surface 14 is configured to move relative to the vertical rail 16*a*, 16*b*. The workstation 10 can be configured such that the work surface 14 can be adjusted along at least portion of the length of the vertical rails 16*a*, 16*b* to any desired vertical height or the work surface 14 can be limited to a predetermined range of vertical heights.

Figure 12:
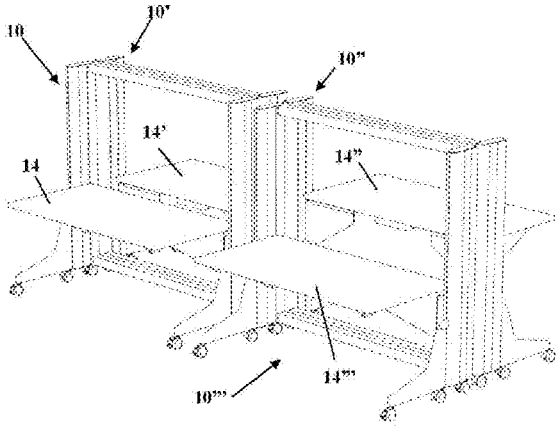
FIG. 12 is a perspective view of a group of workstations according to an embodiment of the invention.

In the example illustrated in FIG. 9, the first vertical height $H_1$ can correspond to a height at which a user would sit at a chair to perform a task on the work surface 14. The second vertical height $H_2$ can correspond to a height which moves the work surface 14 out of the way such that items can be stored below the work surface 14 or a task could be performed below the work surface 14. The height adjustable work surface 14 can be adjusted to accommodate users of a different height and users who are positioned at different heights (e.g. sitting on a chair, standing, sitting on a raised stool). The height adjustable work surface 14 can also be adjusted to accommodate different types of tasks such as using a computer or other instrumentation supported on the work surface 14 or to store items. For example, as illustrated in FIG. 12, multiple workstations 10, 10', 10", and 10'" can be positioned adjacent one another, with each work surface 14, 14', 14", and 14'" independently height adjustable to customize the overall work space.

FIGS. 10-11 illustrate movement of the workstation 10 between the in use mode (FIG. 10) and the storage and/or transportation mode (FIG. 11). As illustrated in FIGS. 10 and 11, the work surface 14, second support arms 42*a*, 42*b*, and the support legs 24, 26 can all be folded inward to decrease a profile of the workstation 10. Starting in the in use mode illustrated in FIG. 10, each of the support legs 24, 26 can be folded inward about their rotatable connection to the vertical rails 16*a*, 16*b*, as illustrated by arrows 110, such that the support legs 24, 26 are facing toward one another and not projecting outward from the vertical rails 16*a*, 16*b*, as illustrated in FIG. 11. The work surface 14 can also be pivoted upward about hinges 46*a*, 46*b* (FIG. 3), as illustrated by arrow 112, into the folded position illustrated in FIG. 11. The second support arms 42*a*, 42*b* can also be folded inward about their hinges 48*a*, 48*b*, as illustrated by arrows 114. Any of the support legs 24, 26, the second support arms 42*a*, 42*b*, and the work surface 14 can be provided with a locking mechanism to secure the component in the folded position. Additionally, or alternatively, the work surface 14 can be weighted on a rear side thereof to facilitate maintaining the work surface 14 in the folded position.

Figure 13:
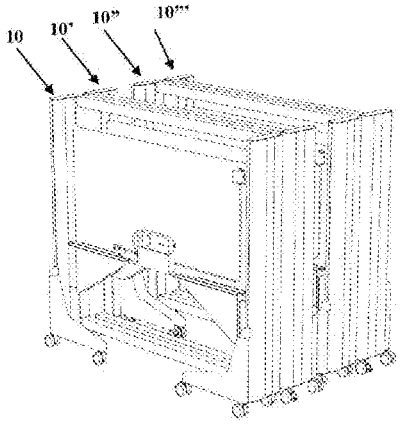
FIG. 13 is a perspective view of a group of workstations according to an embodiment of the invention.

When the support legs 24, 26, the second support arms 42*a*, 42*b*, and the work surface 14 are in the folded position illustrated in FIG. 11, the profile $P_{folded}$ of the workstation 10 is less than the profile $P_{in\ use}$ of the workstation 10 when these components are in their unfolded, extended positions in use, as illustrated in FIG. 10. The decreased profile $P_{folded}$ of the workstation 10 can facilitate storage of the workstation 10 when it is not in use and/or can facilitate transportation of the workstation 10. For example, as can be seen in FIG. 13 the decreased profile $P_{folded}$ of the workstation 10 in the storage/transportation mode allows more of the workstations 10, 10', 10", 10"" to be stored within a given area.

The process can be reversed to change the workstation 10 from the storage/transportation mode of FIG. 11 to the in use position of FIG. 10. The support legs 24, 26 and the second support arms 42*a*, 42*b* can be folded outward into their extended, in use positions, as illustrated by arrows 116 and 118, respectively. The work surface 14 can then be folded downward, as illustrated by arrows 120 into its extended, in use position illustrated in FIG. 10.

In this manner, the workstation 10 provides a height adjustable work surface 14 and an ability to be moved between an in use mode and a storage and/or transportation mode to provide flexibility and adaptability to accommodate different user's needs as well as changing work space needs.

III. Alternative Embodiments

Figure 14:
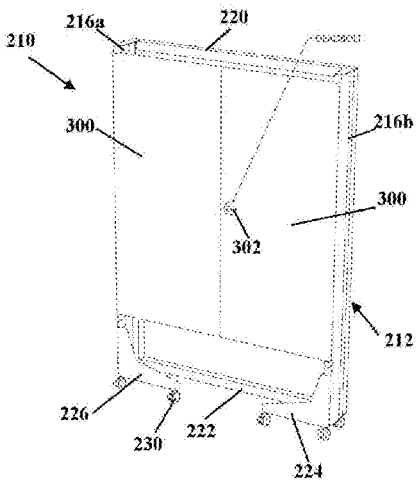
FIG. 14 is a perspective view of a workstation in a storage and/or transportation mode according to an embodiment of the invention.
Figure 15:
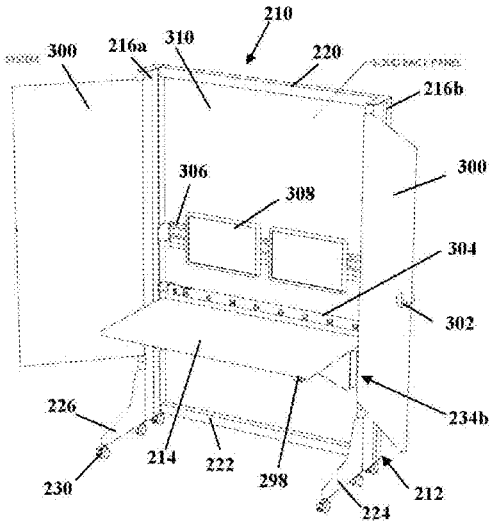
FIG. 15 is a perspective view of the workstation of FIG. 14 in an in use mode according to an embodiment of the invention.

FIGS. 14-15 illustrate an alternative workstation 210 which is similar to the workstation 10 except that the workstation 210 includes additional workstation accessories. Therefore, elements of the workstation 210 similar to those of the workstation 10 are labeled with the prefix 200.

As illustrated in FIGS. 14 and 15, the workstation 210 can include door panels 300 that can optionally include a security mechanism 302, such as a deadbolt lock, to keep the door panels 300 in the closed position shown in in FIG. 14. The door panels 300 can be mounted to the vertical rails 216*a*, 216*b* using any suitable fastener and can optionally be mounted to the vertical rails 216*a*, 216*b* through mounting apertures formed therein, such as the fastening apertures 90*a* illustrated in FIG. 6*a* or any other suitable type of fastener, such as a hinge or pivot mount. The door panels 300 can be pivotably mounted to the vertical rails 216*a*, 216*b* such that they can be swung open to provide access to the work surface 214 stored therein, as illustrated in FIG. 15. The workstation 210 can be changed between the storage and/or transportation mode illustrated in FIG. 14 and the in use mode illustrated in FIG. 15 in a manner similar to that described above for the workstation 10 with respect to FIGS. 10-11 with the additional step of opening and closing the door panels 300.

Referring to FIG. 15, the workstation 210 can include additional optional accessories, such as a power strip 304 and/or an accessory mounting panel 306 that is capable of mounting additional accessories, such as display monitors 308. Either of these types of accessories can be fixedly mounted to the vertical rails 216*a*, 216*b* or optionally height adjustable with the height adjustment of the work surface 214. For example, the power strip 304 and/or an accessory mounting panel 306 can be coupled with the drive system of the workstation 210 that adjusts the height of the work surface 214 in a manner similar to that described above for the work surface 14 of workstation 10. Each end of the power strip 304 and/or an accessory mounting panel 306 can be coupled with a support arm similar to the support arms 34*a*, 34*b* which are coupled with the drive system 60 for adjusting the vertical height of the work surface 14, as described above with respect to the workstation 10 of FIGS. 4-6. In this manner, actuation of the motor control 298 to adjust the vertical height of the work surface 214 would also correspondingly adjust the vertical height of the power strip 304 and/or accessory mounting panel 306. Alternatively, the power strip 304 and/or the accessory mounting panel 306 can be coupled with the work surface 214 and/or the support arms 234*a*, 234*b* such that movement of the work surface 214 results in a corresponding movement of the power strip 304 and/or the accessory mounting panel 306.

The power strip accessory 304 can be provided with power by operably coupling the power strip accessory 304 with the connection hub 92 in a manner similar to that described above for the workstation 10 of FIGS. 8*a*-8*b*. If the connection hub is located within the frame 212, in the same manner as illustrated in FIG. 8*a* with respect to the connection hub 92, then the power strip accessory 304 can be coupled with the connection hub by an extendible/retractable cable, similar to the extendable/retractable cable 82 of workstation 10. Alternatively, if the connection hub is mounted to the work surface 214, as illustrated with respect to the connection hub 92 of FIG. 8*b*, then the power strip accessory 304 can be operably coupled with the connection hub through a fixed length cable. In still another alternative, the power strip accessory 304 can be provided with a power cable (not shown) that can be plugged into a wall socket. Any workstation accessory requiring electrical power and/or a communications link can be operably coupled with the workstation's connection hub or an external source of electrical power and/or communication in a similar manner.

The workstation 210 can also include one or more back panels 310 to provide privacy to a user of the workstation 210 and/or to secure the accessories mounted to the vertical rails 216*a*, 216*b* within the workstation 210 when the door panels 300 are closed such that the accessories cannot be accessed from the back of the workstation 210 when the door panels 300 are closed.

It will be understood that the workstation 210 is not limited to the specific combination of accessories illustrated in FIGS. 14-15, namely, the door panels 300, the security mechanism 302, the power strip 304, the accessory mounting panel 306, the monitors 308, and the back panel 310, but that the workstation 210 can include any combination of fewer or additional accessories. It will also be understood that any combination of all or some of the accessories described with respect to the workstation 210 can be used with any of the additional embodiments of workstations and accessories described herein.

Figure 16:
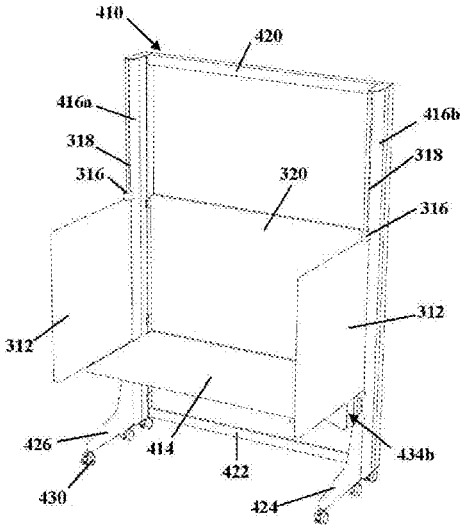
FIG. 16 is a perspective view of a workstation having a work surface adjusted to a first vertical height according to an embodiment of the invention.
Figure 17:
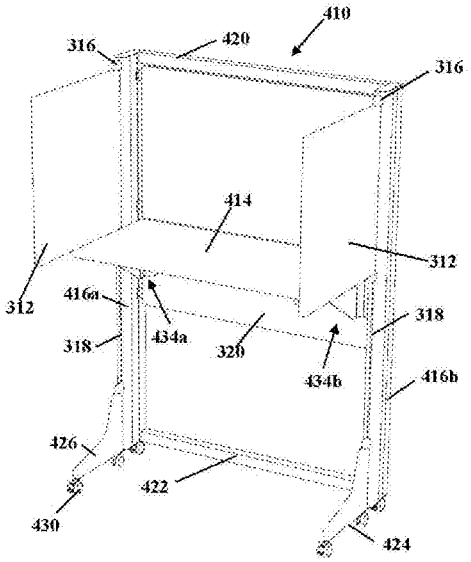
FIG. 17 is a perspective view of the workstation of FIG. 16 having the work surface adjusted to a second vertical height according to an embodiment of the invention.

FIGS. 16-17 illustrate an alternative workstation 410 which is similar to the workstation 10 except that the workstation 410 includes additional examples of workstation accessories. Therefore, elements of the workstation 410 similar to those of the workstation 10 are labeled with the prefix 400.

The workstation 410 can include a pair of door panels 312 and a back panel 314 that are mounted for vertical movement with the work surface 414. Each door panel 312 can be pivotably coupled with a mounting element 316 such that the door panels 312 can be rotated between open and closed positions. The mounting element 316 can be configured to be slidably received within a mounting slot 318 provided in each of the vertical members 416*a*, 416*b*, which can be similar to the aperture 90*a* of the workstation 10 of FIG. 6*a*. When the work surface 414 is unfolded in its extended, in use position, each of the door panels 312 can be coupled with adjacent sides of the work surface 414 such that when the work surface 414 is moved vertically, the door panels 312 can move along with the work surface 414. The door panels 312 and work surface 414 can be coupled using any suitable type of fastener, such a latch or clip mechanism (not shown). As the vertical height of the work surface 414 is adjusted, the mounting elements 316 travel along the mounting slot 318 as the door panels 312 are moved by the work surface 414.

The workstation 410 can optionally include a back panel 320 that is configured for movement along with the work surface 414. The back panel 320 can be coupled with the work surface 414 and/or the work surface mounting arms 434*a*, 434*b* for movement along with the work surface 414. Alternatively, the back panel 320 can be independently coupled with the drive system used to adjust the vertical height of the work surface 414 in a manner similar to that described above for the accessories 304 and 306 of the workstation 210 illustrated in FIGS. 14-15.

It will be understood that the workstation 410 is not limited to the specific combination of accessories illustrated in FIGS. 16-17, namely, the door panels 312 and the back panel 320, but that the workstation 410 can include any combination of fewer or additional accessories. It will also be understood that any combination of all or some of the accessories described with respect to the workstation 410 can be used with any of the additional embodiments of workstations and accessories described herein.

Figure 18:
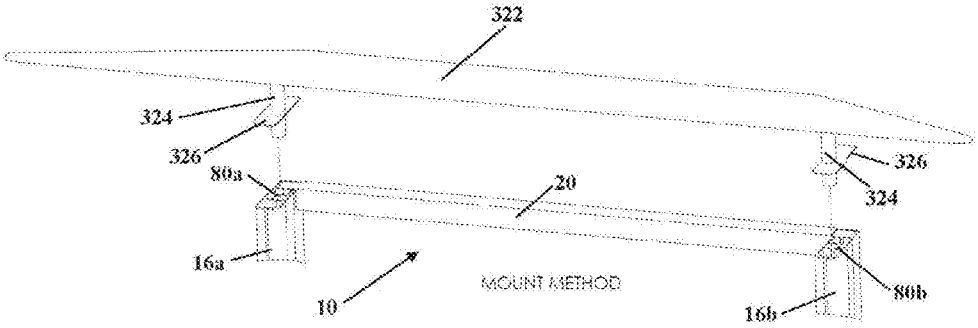
FIGS. 18-22 are a perspective views of exemplary workstation accessories according to various embodiments of the invention.

FIG. 18 illustrates the use of the vertical rails 16*a*, 16*b* for mounting additional accessories to the top of the frame 12. As described above with respect to the workstation 10 of FIG. 6*a*, the vertical rails 16*a*, 16*b* can include one or more cavities 70*a, b*, 74*a, b*, 80*a, b*, and 86*a, b* therein. As illustrated in FIG. 18, one or more of the cavities 70*a, b*, 74 *a, b*, 80 *a, b*, and 86 *a, b* can be used as a mounting aperture for coupling an additional accessory to the upper end of the vertical rails 16*a*, 16*b*.

For example, as illustrated in FIG. 18, an acoustic panel 322 can include a mounting leg 324 on each end configured to be received within the exposed upper end of the cable cavity 80*a*, 80*b* in each of the vertical rails 16*a*, 16*b*, respectively, for supporting the acoustic panel 322. The acoustic panel 322 can also include cover panels 326 on each end adjacent the mounting legs 324 for at least partially closing the upper end of the vertical rails 16*a*, 16*b*.

Figure 19:
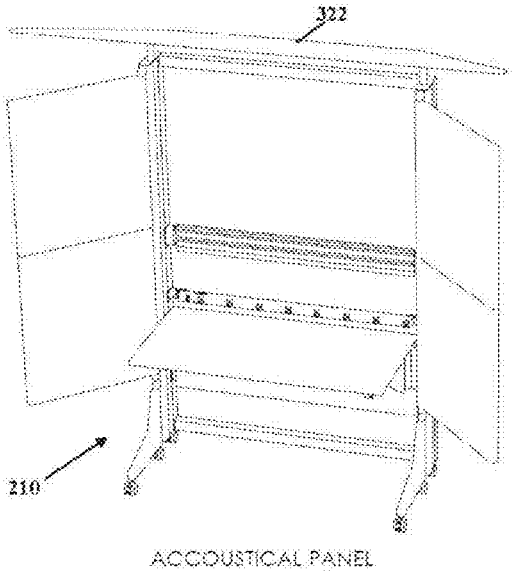
Figure 20:
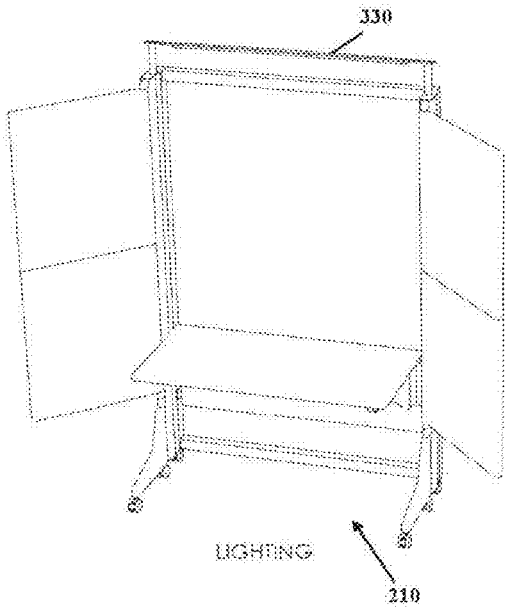
Figure 21:
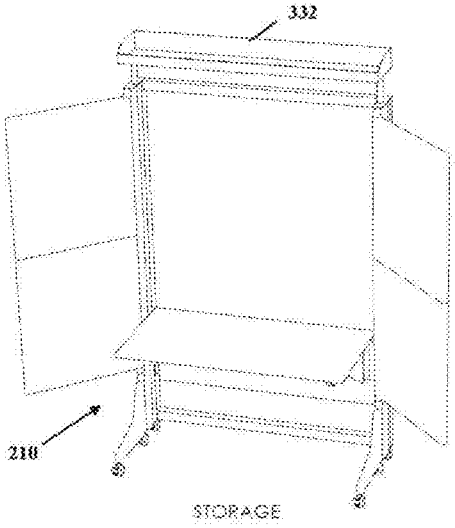
Figure 22:
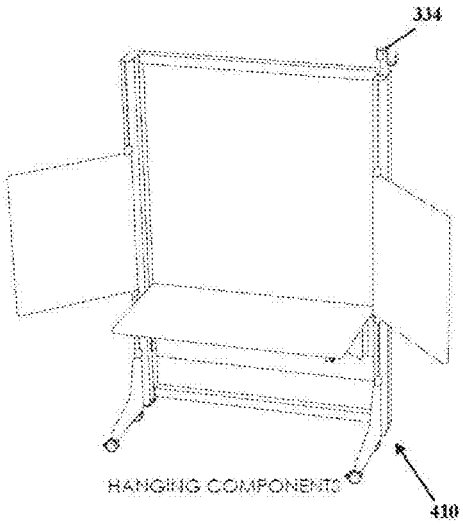

As illustrated in FIGS. 19-22, this type of mounting system can be used to mount a variety of accessories to the various embodiments of the workstations described herein. For example, FIG. 19 illustrates the acoustic panel 322 in use with the workstation 210 of FIGS. 14-15. FIGS. 20 and 21 illustrate a lighting accessory 330 and a shelving accessory 332 that can be coupled with the workstation 210 (power strip and mounting panel accessories 304 and 306 not shown) in a manner similar to that described above for the acoustic panel 322 of FIG. 18. FIG. 22 illustrates a hanging hook accessory 334 that can be coupled with the workstation 410 of FIGS. 16-17 (back panel 320 not shown) in a manner similar to that described above for the acoustic panel 322 of FIG. 18.

The lighting accessory 330 of FIG. 20 can be battery operated or provided with a power cord (not shown) for connection with a suitable source of electrical power, such as a power strip accessory provided with the workstation 210 or a mains power outlet.

Figure 23:
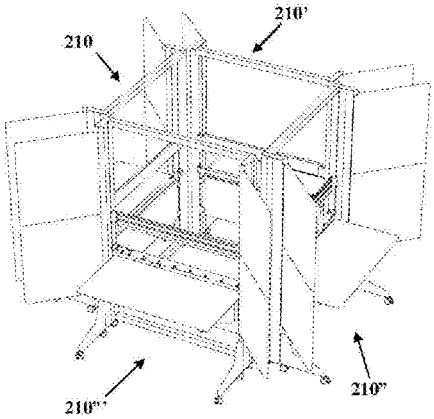
FIGS. 23-24 are a perspective view of groups of workstations according to an embodiment of the invention.
Figure 24:
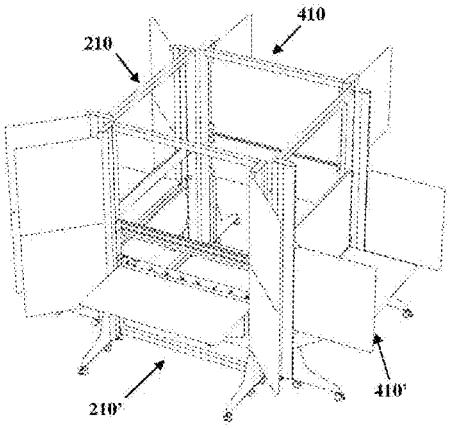

FIGS. 23 and 24 illustrate exemplary combinations of embodiments of the workstations 210 and 410 described herein. FIG. 23 illustrates an example where multiple workstations 210 having similar accessories have been grouped together, with each work surface adjusted to a desired height. FIG. 24 illustrates an example where multiple workstations 210, 410 having different combinations of accessories have been grouped together, with each work surface also adjustable to a desired height.

The workstations described herein are customizable according to the needs of the user, the tasks to be performed, and the requirements of the workspace. Each workstation can be customizable using various combinations of accessories to meet the needs of individual users and to perform different types of tasks within the same work space. Each workstation can also be customized by adjusting the height of the work surface according to the needs of the user or the tasks to be performed. In addition, the workstation is easily folded into a low profile configuration for facilitating transportation and storage of the workstation.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A work station including a work surface upon which a task can be completed and/or an item can be stored, the work station comprising:

a frame comprising a pair of vertical rails connected by at least one horizontal support rail;

a base joined with each of the pair of vertical rails at a first end thereof to support the frame on a surface; and a work surface extending between the pair of vertical rails, the work surface moveable between a first position in which the work surface extends perpendicular to the frame and a second position in which the work surface is parallel with the frame;

a drive system connected to the work surface, wherein the drive system is configured to move the work surface upward and downward along a length of the pair of vertical rails to adjust a height of the work surface; and wherein movement of the work surface from the first position to the second decreases a profile of the work station to facilitate storage and transportation of the work station.

2. The work station of claim 1 comprising at least one door panel pivotally mounted to one of the pair of vertical rails, the at least one door panel moveable between a closed position in which the at least one door panel extends at least partially between the pair of vertical rails and in front of the work surface and an open position in which the at least one door panel extends away from the pair of vertical rails to provide access to the work surface.

3. The work station of claim 1 wherein the base comprises at least one support leg that is moveable between a first position in which the support leg extends perpendicular to the frame and a second position in which the support leg is parallel with the frame.

4. The work station of claim 3 wherein the at least one support leg comprises at least one wheel for rolling movement of the frame over the surface.

5. The work station of claim 1 comprising at least one work station accessory extending between the pair of vertical rails and connected to the drive system to move upward and downward along the length of the pair of vertical rails to adjust a height of the at least one work station accessory.

6. The work station of claim 5 wherein the at least one work station accessory comprises at least one of an acoustical panel, a privacy panel, a display screen, a power strip, an accessory mounting panel, and combinations thereof.

7. The work station of claim 1 wherein each of the pair of vertical rails comprise a mounting channel at a second end, opposite the first end, to support a work station accessory above the frame.

8. The work station of claim 7 wherein the work station accessory comprises at least one of an acoustical panel, a lighting element, a storage shelf, a hanging element, and combinations thereof.

9. A frame for a work station comprising a drive system for adjusting a vertical height of a work surface and a support member coupled with the drive system at one end and coupled with the work surface at an opposite end such that vertical movement of the support member by the drive system adjusts the vertical height of the work surface, the frame comprising:

a pair of vertical side rails, each vertical side rail comprising:

a drive system cavity, wherein at least a portion of the drive system extends through the drive system cavity;

a cable cavity in at least partial communication with the drive system cavity such that at least one cable stored within the cable cavity can pass into the drive system cavity;

a frame connector cavity; and an exit slot extending along at least a portion of a length of the vertical rail and into the drive system cavity to allow the support member and the at least one cable to extend from the drive system cavity through the exit slot to an exterior of the vertical side rail; and a horizontal support rail coupled at a first end with one of the pair of vertical side rails and at a second end with the other of the pair of vertical side rails through the frame connector cavity.

10. The frame of claim 9 comprising a bearing surface cavity, connected with the drive system cavity, to guide a bearing wheel driven by the drive system during adjustment of the vertical height of the work surface.

11. The frame of claim 9 comprising at least one fastening slot for supporting a work station accessory on the frame.

12. The frame of claim 9 wherein the at least one cable comprises at least one of a drive system control cable, a power cable, a communications cable, and combinations thereof.

13. A work station including a work surface upon which a task can be completed and/or an item can be stored, the work station comprising:

a frame comprising a pair of vertical rails connected by at least one horizontal support rail;

a work surface extending between the pair of vertical rails, the work surface moveable between an extended position in which the work surface extends perpendicular to the frame and a folded position in which the work surface is parallel with the frame;

at least one door panel mounted to one of the pair of vertical rails, the at least one door panel moveable between a closed position in which the at least one door panel covers at least a portion of the work surface when the work surface is in the folded position and an open position in which the at least one door panel provides access to the work surface; and a drive system operably coupled with the work surface for adjusting a vertical height of the work surface;

wherein movement of the work surface from the first position to the second decreases a profile of the work station to facilitate storage and transportation of the work station.

14. The work station of claim 13 wherein the drive system is coupled with at least one support member and wherein the work surface is coupled with the at least one support member such that vertical movement of the at least one support member by the drive system adjusts the vertical height of the work surface.

15. The work station of claim 14 wherein each of the pair of vertical rails comprises a drive system.

16. The work station of claim 13 wherein the drive system is housed within a cavity within at least one of the pair of vertical rails and said at least one of the pair of vertical rails includes a slot through which the support member extends from the drive system to mount the work surface exterior of the cavity.

17. The work station of claim 13 wherein the frame is supported on a base comprising at least one pair of support legs that are each moveable between a first position in which at least one of the support legs extends perpendicular to the frame and a second position in which the at least one of the support legs is parallel with the frame, each of the at least one pair of support legs comprising at least one wheel for rolling movement of the frame over the surface.

18. The work station of claim 13 comprising at least one work station accessory coupled with at least one of the drive system or the work station and configured to move vertically to adjust a height of the at least one work station accessory.

19. The work station of claim 13 wherein each of the pair of vertical rails comprise a mounting channel at an upper end thereof to support a work station accessory above the frame.

20. The work station of claim 13 wherein the drive system can be an automatic drive system operated on electrical power or a manual drive system operated by a user of the work station.

* * * * *